US007845118B2

(12) United States Patent
Saurey

(10) Patent No.: US 7,845,118 B2
(45) Date of Patent: Dec. 7, 2010

(54) EAVE FOR A BUILDING

(75) Inventor: Tom Saurey, Littleton, CO (US)

(73) Assignee: Tuff Shed, Inc., Denver, CO (US)

( * ) Notice: Subject to any disclaimer, the term of this patent is extended or adjusted under 35 U.S.C. 154(b) by 305 days.

(21) Appl. No.: 11/684,940

(22) Filed: Mar. 12, 2007

(65) Prior Publication Data

US 2007/0294960 A1 Dec. 27, 2007

Related U.S. Application Data

(63) Continuation-in-part of application No. 11/473,858, filed on Jun. 23, 2006, now Pat. No. 7,694,488.

(51) Int. Cl.
*E04D 13/00* (2006.01)

(52) U.S. Cl. ..... 52/96; 52/94; 52/745.06; 52/58; 52/747.1

(58) Field of Classification Search ..... 52/90.1, 52/94, 95, 96, 745.06, 11, 92.3, 58, 745.11, 52/745.05, 747.1; 29/897.3
See application file for complete search history.

(56) References Cited

U.S. PATENT DOCUMENTS

| | | | | | |
|---|---|---|---|---|---|
| 858,825 | A | * | 7/1907 | Posson | 52/45 |
| 1,186,841 | A | * | 6/1916 | Russell | 52/46 |
| 1,762,756 | A | * | 6/1930 | Braunstein | 52/464 |
| 2,396,828 | A | * | 3/1946 | Carpenter | 52/92.3 |
| 2,401,589 | A | * | 6/1946 | Smith | 52/11 |
| 2,602,968 | A | * | 7/1952 | Simon | 52/264 |
| 2,631,801 | A | * | 3/1953 | Toal | 248/48.1 |
| 2,896,273 | A | * | 7/1959 | Petter | 52/93.1 |
| 3,388,738 | A | * | 6/1968 | Dery | 165/47 |
| 3,436,877 | A | * | 4/1969 | Gunning | 52/11 |
| 3,527,003 | A | * | 9/1970 | Woodard | 52/94 |
| 3,638,373 | A | * | 2/1972 | Chapman | 52/92.2 |
| 3,783,562 | A | * | 1/1974 | Eysenring | 52/69 |
| 3,826,048 | A | * | 7/1974 | Merkin et al. | 52/11 |
| 4,102,307 | A | * | 7/1978 | Cusick et al. | 119/519 |
| 4,160,346 | A | * | 7/1979 | Kaufmann | 52/96 |
| 4,179,857 | A | * | 12/1979 | Danford | 52/71 |
| 4,265,060 | A | * | 5/1981 | Woodhams | 52/95 |
| 4,481,744 | A | * | 11/1984 | Park | 52/92.1 |
| 4,573,293 | A | * | 3/1986 | Park | 52/92.1 |
| 4,608,788 | A | * | 9/1986 | Porter et al. | 52/64 |
| 4,611,443 | A | * | 9/1986 | Jorgensen et al. | 52/95 |
| 4,807,409 | A | * | 2/1989 | Sells | 52/95 |

(Continued)

*Primary Examiner*—Robert J Canfield
*Assistant Examiner*—Matthew J Gitlin
(74) *Attorney, Agent, or Firm*—Townsend and Townsend and Crew LLP

(57) ABSTRACT

According to the invention, a method of making an eave for a roof on a building is disclosed. The method may include providing a structure with at least two sides and a roof frame. The method may further include coupling at least two of a plurality of eave blocks with a first trim piece. The method may also include coupling at least two of the plurality of eave blocks with a second trim piece. The method may further include coupling a roof piece with a top of the roof frame and a top of at least two of the plurality of eave blocks. In some embodiments, the eave blocks may include lumber having a grain direction and the method may include coupling the eave blocks with the first trim piece such that the grain direction is substantially parallel to a length of the first trim piece.

23 Claims, 8 Drawing Sheets

400

U.S. PATENT DOCUMENTS 5,335,462 A * 8/1994 Park ..... 52/95
5,341,611 A * 8/1994 Lewis ..... 52/90.1
5,375,381 A * 12/1994 Park et al. ..... 52/92.1
5,501,043 A * 3/1996 Park ..... 52/92.1
5,540,015 A * 7/1996 Anthony ..... 52/95
5,577,354 A * 11/1996 Van Doren ..... 52/94
5,636,483 A 6/1997 Wille
5,729,933 A * 3/1998 Strength ..... 52/96
5,918,425 A * 7/1999 Archard et al. ..... 52/95
5,941,028 A 8/1999 Hicks
5,950,375 A * 9/1999 Zaccagni ..... 52/94
6,138,418 A * 10/2000 Dyer et al. ..... 52/94
6,272,797 B1 * 8/2001 Finger ..... 52/94
6,301,840 B1 * 10/2001 Spinelli ..... 52/96
6,584,735 B2 * 7/2003 Burton ..... 52/95
6,643,981 B2 * 11/2003 Pina et al. ..... 52/91.2
7,063,481 B2 * 6/2006 Trull ..... 403/170
D524,407 S * 7/2006 Crowley ..... D23/214
7,076,923 B2 * 7/2006 Seldon ..... 52/93.2
7,721,489 B1 * 5/2010 Inzeo ..... 52/95
2001/0027629 A1 * 10/2001 Ojala ..... 52/408
2003/0041531 A1 3/2003 Seldon
2003/0192264 A1 * 10/2003 Boggs ..... 52/94
2004/0139690 A1 * 7/2004 Pina et al. ..... 52/745.15
2007/0204525 A1 9/2007 Bunker

* cited by examiner

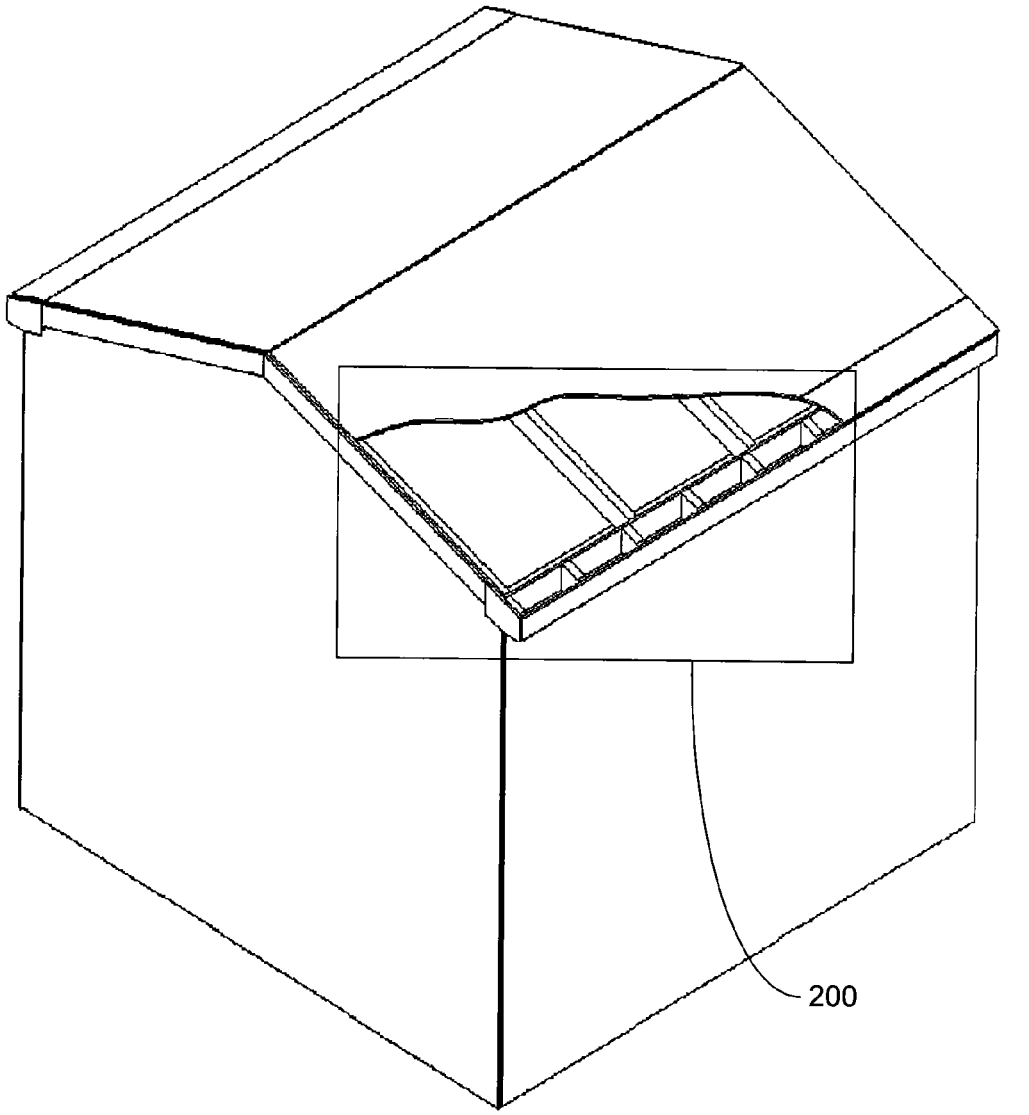
Fig. 1
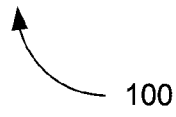

200

300

400

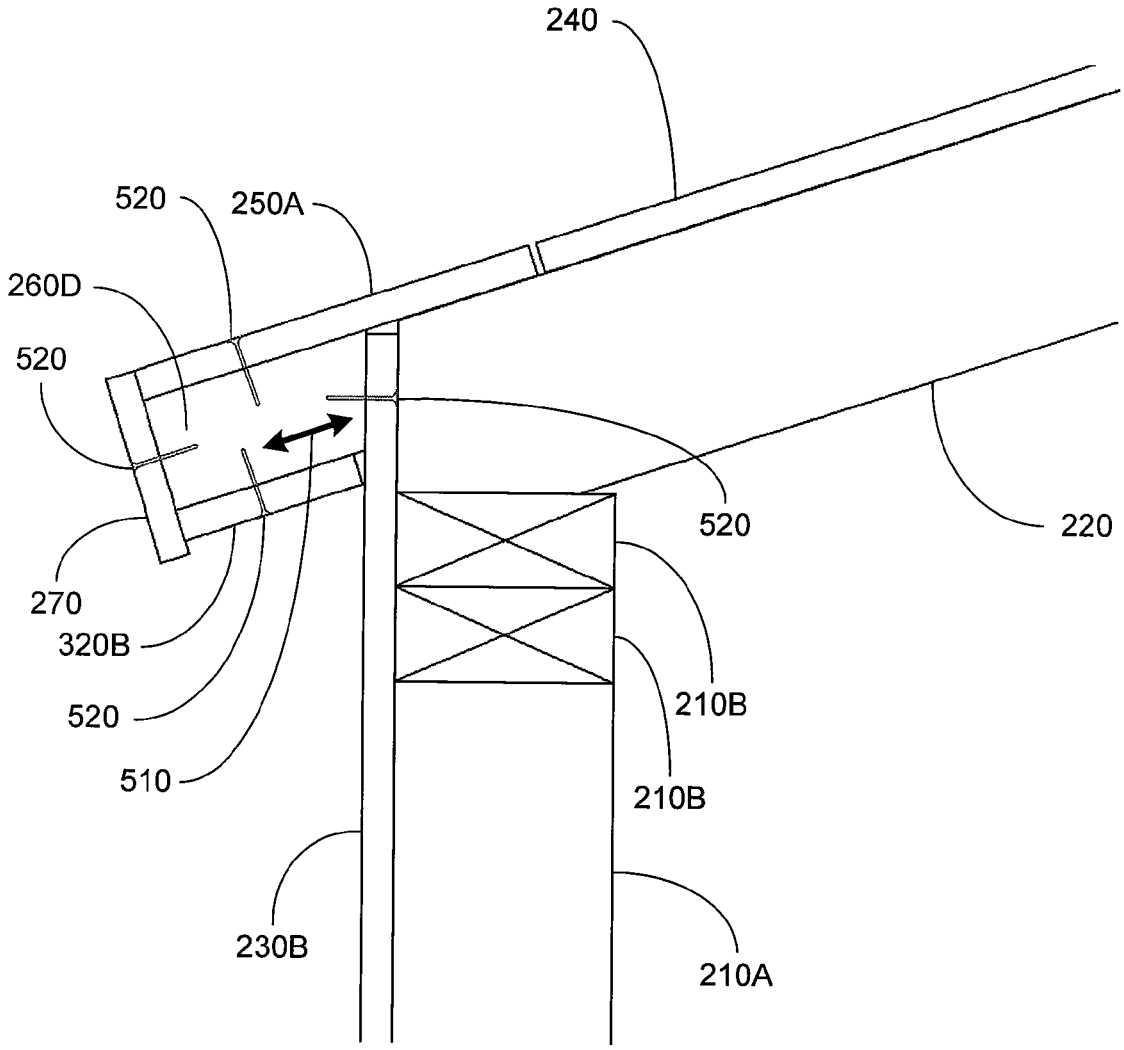
Fig. 5
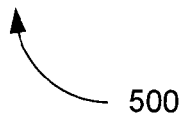

700

800

EAVE FOR A BUILDING

CROSS-REFERENCES TO RELATED APPLICATIONS

This application is a continuation-in-part of U.S. patent application Ser. No. 11/473,858 filed Jun. 23, 2006, entitled "EAVE FOR A BUILDING," the entire disclosure of which is hereby incorporated by reference as if fully set forth herein.

BACKGROUND OF THE INVENTION

This invention relates in general to construction of buildings. More specifically, the invention relates to construction of eaves for roofs on buildings.

Eaves are common on many types of buildings. Eaves extend the roof line some distance beyond the walls of the underlying building, ensuring that water run-off from the roof falls at least a nominal distance from the building's walls. Water that falls near the walls may, over time, damage the walls and/or base of the building. Additionally, eaves may fulfill an aesthetic function.

Eaves may be constructed of a single piece that is attached to the edge of the roof of a building. This type of construction is economical for the builder, but may lead to warping of the eave. This can lead to misalignment of building parts and consequent exposure of the interior of the building to the outside environment. To remedy this problem, eaves are often constructed of multiple pieces to reinforce the structure of the eave and thereby prevent warping.

Present methods in the art involve roofing elements such as rafters penetrating through the sides of a building to frame an eave. This can be a time consuming and undesirable method of construction for multiple reasons. First, siding elements must be cut to a shape that allows the rafters to extend through the voids of the building. Irregularities in cutting these void shapes may additionally compromise any nominal seal between building pieces.

Alternatively, the siding components of the building may be cut shorter to allow rafters to pass over the siding. However, this results in an incomplete interior wall, with voids over the interior wall extending away from the interior in-between the rafters. In other present methods, a thin sheet may be attached to the underside of the eave. While this may assist in preventing the eave from warping, it will not add significant additional structural support to the eave. Embodiments of the present invention provide solutions to these and other issues.

BRIEF DESCRIPTION OF THE INVENTION

In one embodiment, a method of making an eave for a roof on a building is provided. The method may include providing a structure with at least two sides and a roof frame. The method may further include coupling at least two of a plurality of eave blocks with a first trim piece. In some embodiments, a second eave trim piece may also be coupled with at least two of the plurality of eave blocks. The method may also include a step of coupling at least two of the plurality of eave blocks with a side of the structure. The method may additionally include coupling a roof piece with a top of the roof frame and a top of at least two of the plurality of eave blocks.

In another embodiment, a kit for making a building with an eave is provided. The kit may include a plurality of frame and siding members which may assembled to frame and side a structure with at least two sides and a roof frame. The kit may further include a plurality of eave blocks, a first trim piece, and a roof piece. At least two of the plurality of eave blocks may be coupled with the first trim piece and at least two of the plurality of the eave blocks may be coupled with a side of the structure. The roof piece may be coupled with a top of the roof frame and a top of at least two eave blocks.

In another embodiment, a building with an eave is provided. The building may include a structure with at least two sides and a roof frame. The building may further include a first trim piece and a plurality of eave blocks. At least two of the plurality of eave blocks may be coupled with the first trim piece, and at least two of the plurality of eave blocks may be coupled with a side of the structure. The building may also include a roof piece. The roof piece may be coupled with a top of the roof frame and a top of at least two of the plurality of eave blocks.

In another embodiment, a method of making an eave for a roof on a building is provided. The method may include providing a structure with at least two sides and a roof frame. The method may also include coupling at least two of a plurality of eave blocks with a first trim piece. The method may further include coupling at least two of the plurality of eave blocks with a second trim piece. The method may also include coupling a roof piece with a top of the roof frame and a top of at least two of the plurality of eave blocks. In some embodiments, the eave blocks may each include a piece of lumber having a grain direction, and the eave blocks may be coupled with the first trim piece such that the grain direction is substantially parallel to a length of the first trim piece.

In another embodiment, a kit for making a building with an eave is provided. The kit may include a plurality of frame and siding members which may assembled to frame and side a structure with at least two sides and a roof frame. The kit may also include a plurality of eave blocks, a first trim piece, and a roof piece. At least two of the plurality of eave blocks may be coupled with the first trim piece; and the roof piece may be coupled with a top of the roof frame and a top of at least two eave blocks. In some embodiments, the eave blocks may each include a piece of lumber having a grain direction, and the kit may further include instruction instructing a user to couple the eave blocks with the first trim piece such that the grain direction is substantially parallel to a length of the first trim piece.

In another embodiment, a building with an eave is provided. The building may include a structure with at least two sides and a roof frame. The building may also include a first trim piece, a roof piece, and a plurality of eave blocks. The roof piece may be coupled with a top of the roof frame; at least two of the plurality of eave blocks may be coupled with the first trim piece, and at least two of the plurality of eave blocks may be coupled with the roof piece. In some embodiments, the eave blocks may each include a piece of lumber having a grain direction, and the eave blocks may be coupled with the first trim piece such that the grain direction is substantially parallel to the length of the first trim piece.

BRIEF DESCRIPTION OF THE DRAWINGS

The present invention is described in conjunction with the appended figures:

FIG. 1 is an isometric view of a building having an eave of the invention;

FIG. 5 is a cross-sectional view of an alternative eave of the invention similar to that shown in FIG. 3;

Figure 2:
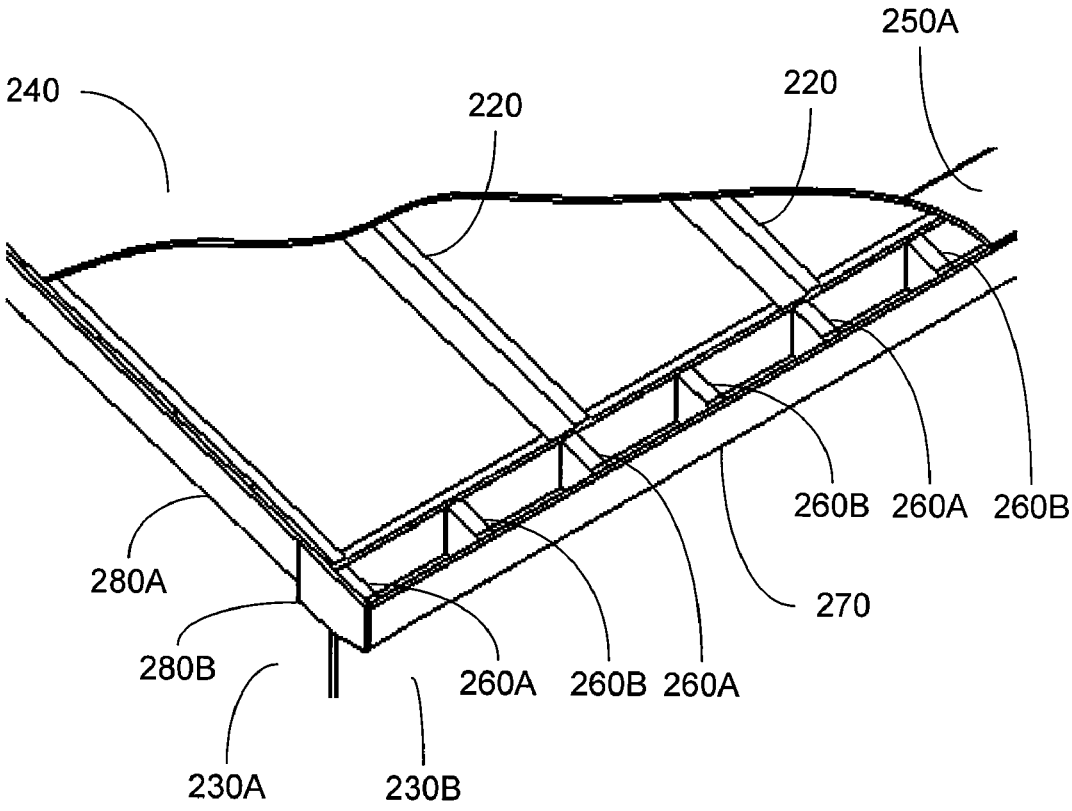
FIG. 2 is a closer isometric view of a portion of the eave shown in FIG. 1.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing an exemplary embodiment. It will be understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, methods, processes, and other components may be shown in block diagram form in order not to obscure the embodiments in unnecessary detail. In other instances, well-known processes, structures, and techniques may be shown without unnecessary detail in order to avoid obscuring the embodiments.

Also, it is noted that individual embodiments may be described as a process which is depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process may be complete when its operations are completed, but could have additional steps not included in a figure. A process may correspond to a method, a procedure, etc.

For the purposes of this description, an "eave" is defined as the part of a roof that extends outward from the walls of a building or structure. The "top of a building," "top of a structure," or similar terms, are defined as the part of a building or structure on which a roof is constructed.

Coupling in any of the steps and/or embodiments of the invention may, merely by way of example, include fastening with nails, fastening with screws, fastening with nuts and bolts, fastening with rivets, fastening with glue, fastening with staples and/or fastening with woodworking joints (for example, dowel, dovetail, and/or finger joints). The frame members, siding members, eave blocks, trim pieces, roof piece and/or any other component of the invention may, merely by way of example, be made from oriented strand board, particle board, fibreboard, plywood, structurally insulated panels, siding material, vented soffit material, wood, cement board, composite, plastic, polymer and/or metal.

In some embodiments, the eave blocks may, merely by way of example, be cut from 2-by-4 softwood lumber. As known in the art, a 2×4 piece of softwood lumber has a cross section with actual dimensions of about 1½ inches (3.8 centimeters) by about 3½ inches (8.9 centimeters).

In some embodiments, the trim pieces may, merely by way of example, be cut from a trim piece that has a width of about 2½ inches (6.4 centimeters) to about 5½ inches (14.0 centimeters), and in some cases, either about 3½ inches (8.9 centimeters) or about 5½ inches (14.0 centimeters). The thickness of the trim piece may be about ⅜ of an inch (0.95 centimeters) to about ¾ of an inch (1.9 centimeters), and in some cases may be about ½ of an inch (1.3 centimeters).

In one embodiment, a method of making an eave for a roof on a building is provided. The method may include providing a structure with at least two sides and a roof frame. The method may further include coupling at least two of a plurality of eave blocks with a first trim piece. The method may also include a step of coupling at least two of the plurality of eave blocks with a side of the structure. The method may additionally include coupling a roof piece with a top of the roof frame and a top of at least two of the plurality of eave blocks.

In some embodiments, the first trim piece may be coupled with a side of the eave blocks. In other embodiments, a second trim piece may also be coupled with a bottom of the eave blocks. The eave blocks may be coupled with either one of or both of the trim pieces prior to coupling the eave blocks with the side of the structure. In some embodiments the eave blocks may be coupled with the roof piece prior to coupling the eave blocks with the side of the structure.

In some embodiments, the second trim piece may be vented soffit material or other materials with passages which allow air flow through the material. In these embodiments, passages which allow air flow may also be made through the sides of the building above the level of the second trim piece. These passages may possibly be created by drilling or other similar method. In other embodiments, the siding of the building may be cut short so as to allow air to flow over the top of the siding and through the vented eave. In some embodiments, materials such as vented soffit material may be used for at least a portion of the upper side of the building to create the air flow passages. The combination of these air flow passages may allow air to move between the inside of the building, the inside of the eave, and the outside of the building.

In some embodiments, the roof piece may be coupled with the top of the structure and the top of the eave blocks such that the roof piece extends onto at least a portion of the top of the roof frame. In other embodiments, the roof piece may extend substantially to the highest vertical point on the top of the roof frame. In embodiments where the roof piece extends partially onto the top of the roof frame, a roofing sheet may be coupled with the top of the roof frame to complete the roof in the area between the roof piece and the highest vertical point on the top of the roof frame.

In some embodiments, coupling the eave blocks with the first trim piece may include coupling the eave blocks at regular or irregular intervals along a length of the first trim piece. In these or other embodiments, coupling the eave blocks with the side of the structure may include coupling every other eave block coupled along at least some portion of the length of the first trim piece with the side of the structure.

In some embodiments, the roof frame may include at least one rafter element which ends at an interior of a side of the structure. In these embodiments, coupling the eave blocks with the side of the structure may include coupling at least one of the eave blocks with at least one of the rafter elements. In some embodiments, eave blocks may be coupled with the side of the structure, in-between the locations where the rafter elements end at an interior of the side of the structure. In these embodiments, an eave block may be coupled with the roof piece and/or trim pieces at a location on the outside of the side of the structure that corresponds with the location of the rafter element on the inside of the structure, but may or may not be coupled with the side of the structure.

In embodiments where the roof frame comprises at least one rafter element, at least a portion of the top of the eave blocks may be parallel with a top of the rafter elements. In some embodiments, the top of the eave blocks may have multiple faces, with one being at an angle parallel with the rafter elements. In various embodiments, the angle of the roof compared to the ground (or other generally horizontal plane) may be between about 9 degrees and about 45 degrees. For example, in some embodiments where the structure is a barn or other building with a steep roof angle, at least a portion of the top of the eave blocks may have a matching steep angle. In another example, where the structure is a shed or other building with a shallow roof angle, at least a portion of the top of the eave blocks may have a matching shallow angle.

In another embodiment, a kit for making a building with an eave is provided. The kit may include a plurality of frame and siding members which may assembled to frame and side a structure with at least two sides and a roof frame. The kit may further include a plurality of eave blocks, a first trim piece, and a roof piece. At least two of the plurality of eave blocks may be coupled with the first trim piece and at least two of the plurality of the eave blocks may be coupled with a side of the structure. The roof piece may be coupled with a top of the roof frame and a top of at least two eave blocks.

In some embodiments, a side of the eave blocks may be coupled with the first trim piece. In other embodiments, the kit may also contain a second trim piece, and the second trim piece may be coupled with a bottom of the eave blocks.

In some embodiments, the kit may further include instructions instructing a user to couple the eave blocks with the first trim piece prior to coupling the eave blocks with the side of the structure. Additional and/or alternative instructions may also be provided instructing a user to couple the eave blocks with a second trim piece and/or with the roof piece prior to coupling the eave blocks with the side of the structure. Various other possible instructions are also possible, including those instructing a user to couple any of the aforementioned components with each other prior to coupling with other aforementioned components.

Other possible instructions include instructing a user to only couple certain eave blocks with certain other components. For example, in some embodiments, the kit may include instructions instructing a user to couple at least a portion of the total number of eave blocks with the first trim piece at various intervals along the length of the first trim piece. The instructions may further instruct a user to thereafter couple only every other eave block along some portion of the length of the first trim piece with the side of the structure. Which eave blocks the instructions instruct a user to couple with the side of the structure may be related to locations of rafter elements which terminate on the inside of the side of the structure. In some embodiments, the instructions may instruct the user to only couple the eave blocks not at a location corresponding with the location of an interior rafter element. In some kit embodiments, at least a portion of the top of the eave blocks may be parallel with a top of rafter elements present in the roof frame of the structure.

In some embodiments, various components of the kit may be pre-coupled. In some embodiments the roof piece, the first trim piece, and/or the second trim piece may be pre-coupled with the eave blocks. In these embodiments, the pre-coupled piece may then be coupled with the top of the roof frame and/or the side of the structure to make an eave.

In another embodiment, a building with an eave is provided. The building may include a structure with at least two sides and a roof frame. The building may further include a first trim piece and a plurality of eave blocks. At least two of the plurality of eave blocks may be coupled with the first trim piece, and at least two of the plurality of eave blocks may be coupled with a side of the structure. The building may also include a roof piece. The roof piece may be coupled with a top of the roof frame and a top of at least two of the plurality of eave blocks.

In some embodiments, the first trim piece may be coupled with a side of the eave blocks. In other embodiments, the building may also include a second trim piece, which may be coupled with a bottom of the eave blocks. In various embodiments, only some eave blocks may also be coupled with the side of the structure as discussed above in regards to the method and kit embodiments of the invention.

In another embodiment, a method of making an eave for a roof on a building is provided. The method may include providing a structure with at least two sides and a roof frame. The method may also include coupling at least two of a plurality of eave blocks with a first trim piece. The method may further include coupling at least two of the plurality of eave blocks with a second trim piece. The method may also include coupling a roof piece with a top of the roof frame and a top of at least two of the plurality of eave blocks. In some embodiments, the eave blocks may be coupled with the first trim piece prior to coupling the roof piece with the top of at least two of the plurality of eave blocks. In some embodiments, the roof piece may be coupled with the eave blocks prior to the roof piece being coupled with the top of the roof frame. In some embodiments, the eave blocks may each include a piece of lumber having a grain direction, and the eave blocks may be coupled with the first trim piece such that the grain direction is substantially parallel to a length of the first trim piece. In other embodiments, only one eave block may be used and may run substantially along the entire length of the eave.

In another embodiment, a kit for making a building with an eave is provided. The kit may include a plurality of frame and siding members which may be assembled to frame and side a structure with at least two sides and a roof frame. The kit may also include a plurality of eave blocks, a first trim piece, and a roof piece. At least two of the plurality of eave blocks may be coupled with the first trim piece; and the roof piece may be coupled with a top of the roof frame and a top of at least two eave blocks. In some embodiments, at least two eave blocks may be coupled with at least one of the first trim piece and the roof piece in the kit. This may allow a user of the kit to save time during assembly of the kit. In other embodiments, the eave blocks may each include a piece of lumber having a grain direction, and the kit may further include instruction instructing a user to couple the eave blocks with the first trim piece such that the grain direction is substantially parallel to a length of the first trim piece.

In another embodiment, a building with an eave is provided. The building may include a structure with at least two sides and a roof frame. The building may also include a first trim piece, a roof piece, and a plurality of eave blocks. The roof piece may be coupled with a top of the roof frame, at least two of the plurality of eave blocks may be coupled with the first trim piece, and at least two of the plurality of eave blocks may be coupled with the roof piece. In some embodiments, the eave blocks may each include a piece of lumber having a grain direction, and the eave blocks may be coupled with the first trim piece such that the grain direction is substantially parallel to the length of the first trim piece.

Turning now to FIG. 1, an isometric view of a building 100 having an eave of the invention is shown. A portion of the building 200 shown in FIG. 1 is shown in a closer view in FIG. 2.

In FIG. 2, rafter elements 220 are shown making a roof frame. Siding members 230 are shown forming the sides of the structure. A roof sheet 240 is shown cut-away to reveal the roof frame constructed of rafter elements 220. A roof piece 250 is also shown cut-away to reveal eave blocks 260. A first trim piece 270 is shown coupled with the side of at least some of the eave blocks 260. Additionally, aesthetic trim pieces 280 are also shown.

In some embodiments, all eave blocks 260 may be coupled with the side of the structure through siding member 230B. The coupling mechanism, nails for example, may also couple the eave blocks 260 with other members and/or elements of the structure. In other embodiments, only every other eave block 260 may be coupled with the side of the structure. For example, in some embodiments, eave blocks 260B may be coupled with the side of the structure while eave blocks 260A may not. The proximity of rafter elements 220 to eave blocks 260A may make it more difficult in some embodiments to perform coupling operations such as nailing or screwing components of the invention. Eave blocks 260B on the other hand may easily be coupled from the interior of the structure, free from obstruction by the rafter elements 220. In other embodiments, eave blocks 260 may be located such that no eave block 260 is proximate to rafter elements 220. In some embodiments, merely by way of example, the structure may be constructed such that the rafter elements are spaced at about 24 inch intervals (61.0 centimeters), center-to-center. In these or other embodiments, eave blocks 260 may be coupled with the side of the building such that eave blocks 260 are spaced at about 12 inch intervals (30.5 centimeters), center-to-center. In some embodiments, the centers of eave blocks 260 may be substantially aligned with the center of rafter elements 220. In other embodiments, the centers of eave blocks 260 may be offset from the center of rafter elements 220.

Also shown in this embodiment is roof piece 250. In this embodiment, roof piece 250 extends to only a portion of the top of the roof frame. In other embodiments, roof piece 250 may extend to a greater portion of the top of the roof frame. In some embodiments, roof piece 250 may extend substantially to the highest vertical point at the top of the roof frame. In embodiments where roof piece extends only partially to the top of the roof frame, a roof sheet 240 may be coupled with the top of the roof frame to complete the roof of the structure.

Figure 3:
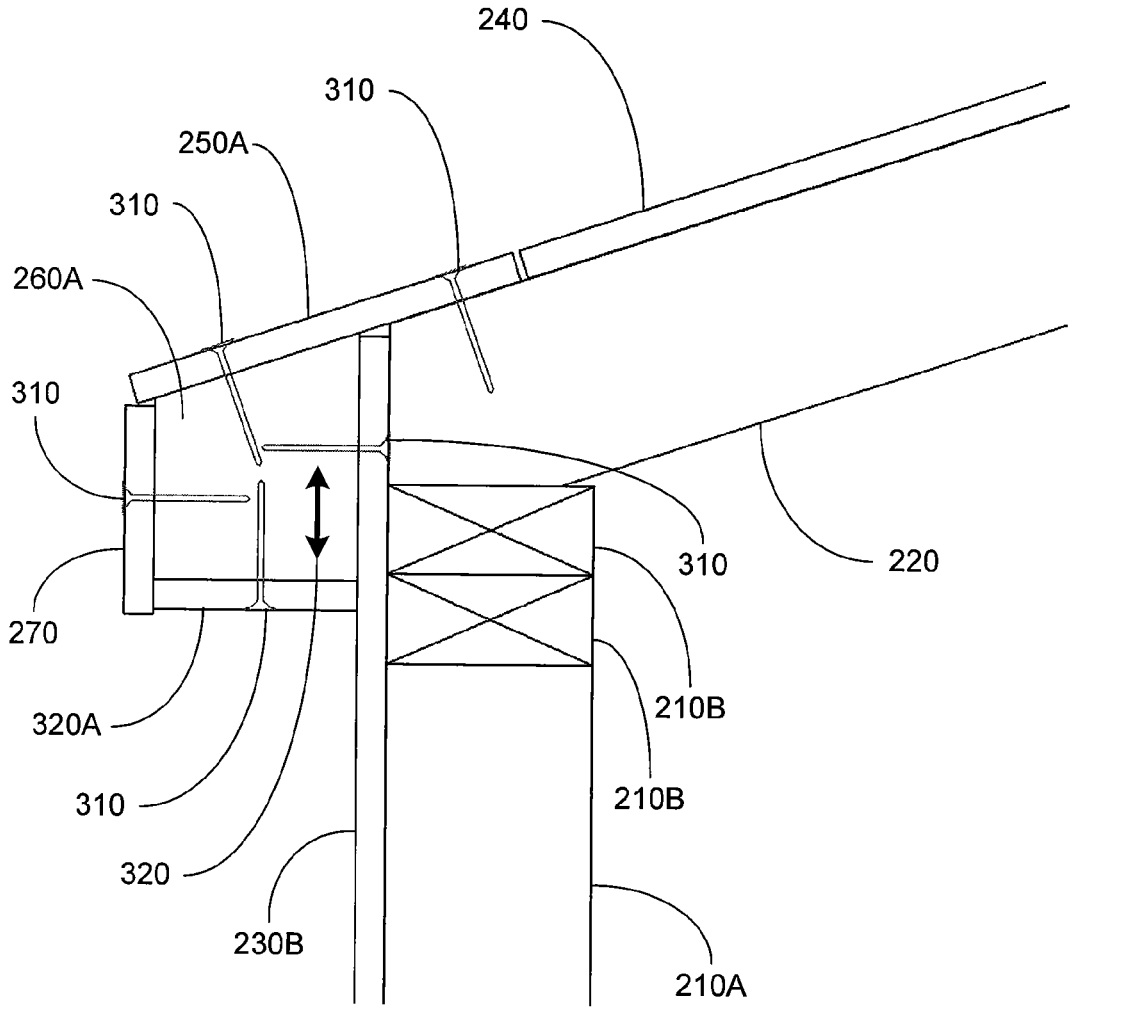
FIG. 3 is a cross-sectional view of the eave shown in FIG. 2.

FIG. 3 shows a cross-sectional view 300 of the eave shown in FIG. 2. In FIG. 3, one possible fastening mechanism, nails 310, is shown coupling the various components of the eave with the building. Additionally, a second trim piece 320A is also shown coupled with eave block 260A. In some embodiments, eave block 260A may first be coupled with first trim piece 270 prior to being coupled with the side of the structure. In other embodiments, second trim piece 320A or roof piece 250A may be coupled with eave block 260A prior to eave blocks 260 being coupled with the side of the structure. Though FIG. 3 shows eave block 260A coupled with the side of the structure, note that as discussed above, not all eave blocks 260 may be coupled with the side of the structure. In some embodiments, all eave blocks 260 may be coupled with the side of the structure. In other embodiments, less than all eave blocks 260 may be coupled with the side of the structure. Also shown on FIG. 3 are vertical structural members 210A and horizontal structural members 210B.

As discussed above, eave block 260A may be cut from a 2-by-4 piece of softwood lumber. The lengthwise grain direction of the 2-by-4 piece of softwood lumber may be in the same direction as directional arrow 320. In some embodiments, this may advantageously allow eave block 260 to be cut from short scrap pieces of 2-by-4 piece of softwood lumber used to frame the building. It will now be apparent that the eave block 260 may also possibly be cut from other small scrap or leftover pieces from other areas of the structure's construction.

In this embodiment, eave block 260A may be dimensioned as follows: the bottom may be about 3.5 inches (8.9 centimeters) in length; the top may be in the range of about 3.5 inches (9.1 centimeters) to about 4.0 inches (10.2 centimeters) in length, and in some cases may be about 3.7 inches (9.4 centimeters) in length; the left side may be about 3 inches (7.6 centimeters) in length; and the right side may be in the range of about 3.8 inches (9.7 centimeters) to about 4.8 inches (12.2 centimeters) in length, and in some cases may be about 4 inches (10.2 centimeters) in length. The width of eave block 260A may be about 1.5 inches (3.8 centimeters). The dimensions of the top and right side of the eave block may, in some embodiments, depend on the slope of the rafter elements of the structure. In some embodiments, at least some of the dimensions of the eave blocks may depend on the dimensions of the trim pieces. In some embodiments, at least some of the dimensions of the eave blocks may be substantially the same as dimensions of the trim pieces.

This may reduce construction costs associated with using a new piece of material to support the eave of the building. Additionally, construction costs of the methods, kits, and buildings of the present invention will also be reduced compared to using a new, continuous length piece of material to support the eave along the length of the side of the structure at the interface of the side of the structure and the eave. Furthermore, the strength of the eave may be improved because the eave is now fully supported under its entire width from the side of the structure.

It will also now be apparent to those skilled in the art that embodiments of the present invention may also have aesthetic and practical advantages over existing building construction methods that extend rafter elements through the side of a structure. The present invention may not require the siding elements 230 of the structure to be cut short or to be cut to odd shapes to permit penetration by the rafter elements 220. This may assist in maintaining the nominal seal provided by the construction between the interior and the exterior of the structure. The interior of the building may also be more aesthetically pleasing because the walls of the building of the present invention may run from floor to roof continuously, without voids between rafter elements 220. Additionally, existing building construction methods may be more time consuming for all of the aforementioned reasons than the methods of the present invention, and thus more costly.

Other advantages may also exist over existing eave constructions that attach a sheet or trim piece with the underside of the eave. Aesthetically, the face of a first trim piece 270 coupled with the side of the eave blocks 260 may be more pleasing than the edge of a roof piece 250 and/or other components. Additionally, the first trim piece 270 and the eave blocks 260 may provide a stronger mounting point for such things as gutters and lights which may not be sufficiently supported by existing eave types that have little or no structural support for the eave.

Figure 4:
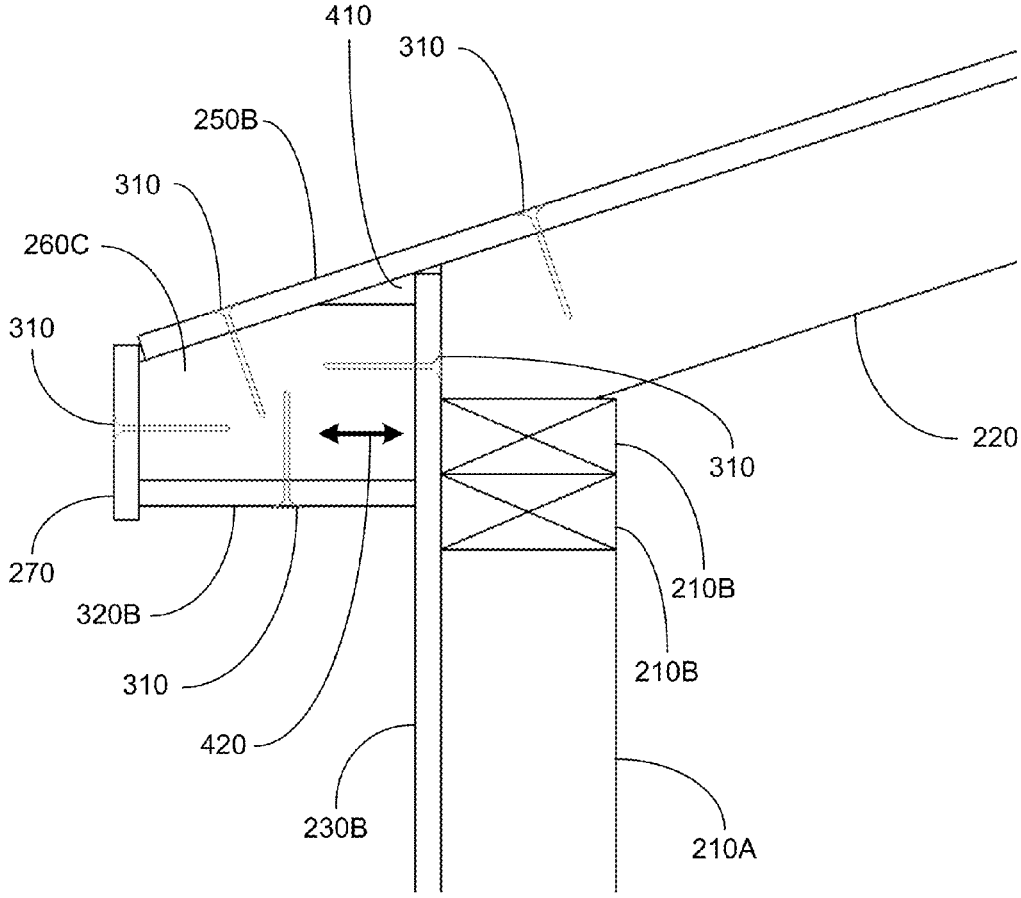
FIG. 4 is a cross-sectional view of an alternative eave of the invention similar to that shown in FIG. 3.

FIG. 4 shows a cross-sectional view 400 of an alternative eave of the invention to that shown in FIG. 3. In this embodiment, note that roof piece 250B extends further on to the top of the roof frame. Also note that the roof block 260C is of a different configuration than that shown in FIG. 3. Eave block 260C differs from eave block 260 shown in FIG. 3 in that a portion of the top of eave block 260C is parallel to the top of rafter element 220. Note that a portion of eave block 260C is not parallel to the top of rafter element 220, thereby leaving a gap 410 between the siding element 230B, roof piece 250B, and eave block 260C. In some embodiments, the entire top of eave block 260C may be parallel to rafter element 220 thereby eliminating gap 410 in those embodiments.

In this embodiment, eave block 260C may be dimensioned as follows: the bottom may be in the range of about 5.5 inches (14.0 centimeters) to about 8.0 inches (20.3 centimeters) in length; the sloped portion of the top may be in the range of about 1.0 inches (2.5 centimeters) to about 5.0 inches (12.7 centimeters) in length, and in some cases may be about 3.7 inches (9.4 centimeters) in length; the horizontal portion of the top may be in the range of about 1.0 inches (2.5 centimeters) to about 7.0 inches (17.8 centimeters) in length, and in some cases may be about 2.1 inches (5.3 centimeters) in length; the left side may be about 2.3 inches (5.8 centimeters) in length; and the right side may be about 3.5 inches (8.9 centimeters) in length. The width of eave block 260A may be about 1.5 inches (3.8 centimeters). The dimensions of the top and left side of the eave block may, in some embodiments, depend on the slope of the rafter elements of the structure. In some embodiments, at least some of the dimensions of the eave blocks may depend on the dimensions of the trim pieces. In some embodiments, at least some of the dimensions of the eave blocks may be substantially the same as dimensions of the trim pieces.

As discussed above, eave block 260C may be cut from a 2-by-4 piece of softwood lumber. The lengthwise grain direction of the 2-by-4 piece of softwood lumber may be in the same as directional arrow 420. In some embodiments, this may advantageously allow eave block 260 to be cut from short scrap pieces of 2-by-4 piece of softwood lumber used to frame the building. Just as in regard to FIG. 3, advantages may be achieved in using such a type of construction.

FIG. 5 shows a cross-sectional view 500 of an alternative eave of the invention to that shown in FIG. 3. Note that the roof block 260D is of a different configuration than that shown in FIG. 3. In this embodiment, eave block 260D differs from eave block 260A shown in FIG. 3 in that the top of eave block 260D may be the widest face of eave block 260D. This top-most and wider face of eave block 260D may be substantially parallel to the top of rafter element 220. In some embodiments, eave block 260D may be a piece of 2-by-4 piece of softwood lumber with its grain, and smaller dimensioned side, substantially parallel to rafter element 220, as shown by directional arrow 510. Also note that the coupling mechanism, nails 520 in this example, may be dimensionally smaller than in other embodiments where the eave block 260 is configured differently. Though FIG. 5 shows the bottom of first trim piece 270 not being flush with second trim piece 320B, in some embodiments, they may be flush. The same is possible in all other embodiments described herein, such as those shown in the other figures. Likewise, though a gap is shown between roof piece 250 and roof sheet 240 in FIG. 5, in some embodiments the gap may instead be between first trim piece 270 and roof piece 250, with the gap as shown in FIG. 5 being closed. In some embodiments, no gap may exist between any of these three elements. The same is possible in all other embodiments described herein, such as those shown in the other figures.

In this embodiment, eave block 260D may be dimensioned as follows: the bottom may be in the range of about 3.0 inches (7.6 centimeters) to about 6.0 inches (12.2 centimeters) in length; the top may be in the range of about 3.25 inches (8.3 centimeters) to about 7.0 inches (17.8 centimeters) in length, and in some cases may be about 3.7 inches (9.4 centimeters) in length; the left side may be about 1.5 inches (3.8 centimeters) in length; and the right side may be in the range of about 1.5 inches (3.8 centimeters) to about 2.5 inches (6.4 centimeters) in length, and in some cases may be about 1.6 inches (4.1 centimeters) in length. The width of eave block 260A may be about 3.5 inches (8.9 centimeters). The dimensions of the top, bottom, and right side of the eave block may, in some embodiments, depend on the slope of the rafter elements of the structure. In some embodiments, at least some of the dimensions of the eave blocks may depend on the dimensions of the trim pieces. In some embodiments, at least some of the dimensions of the eave blocks may be substantially the same as dimensions of the trim pieces.

Figure 6:
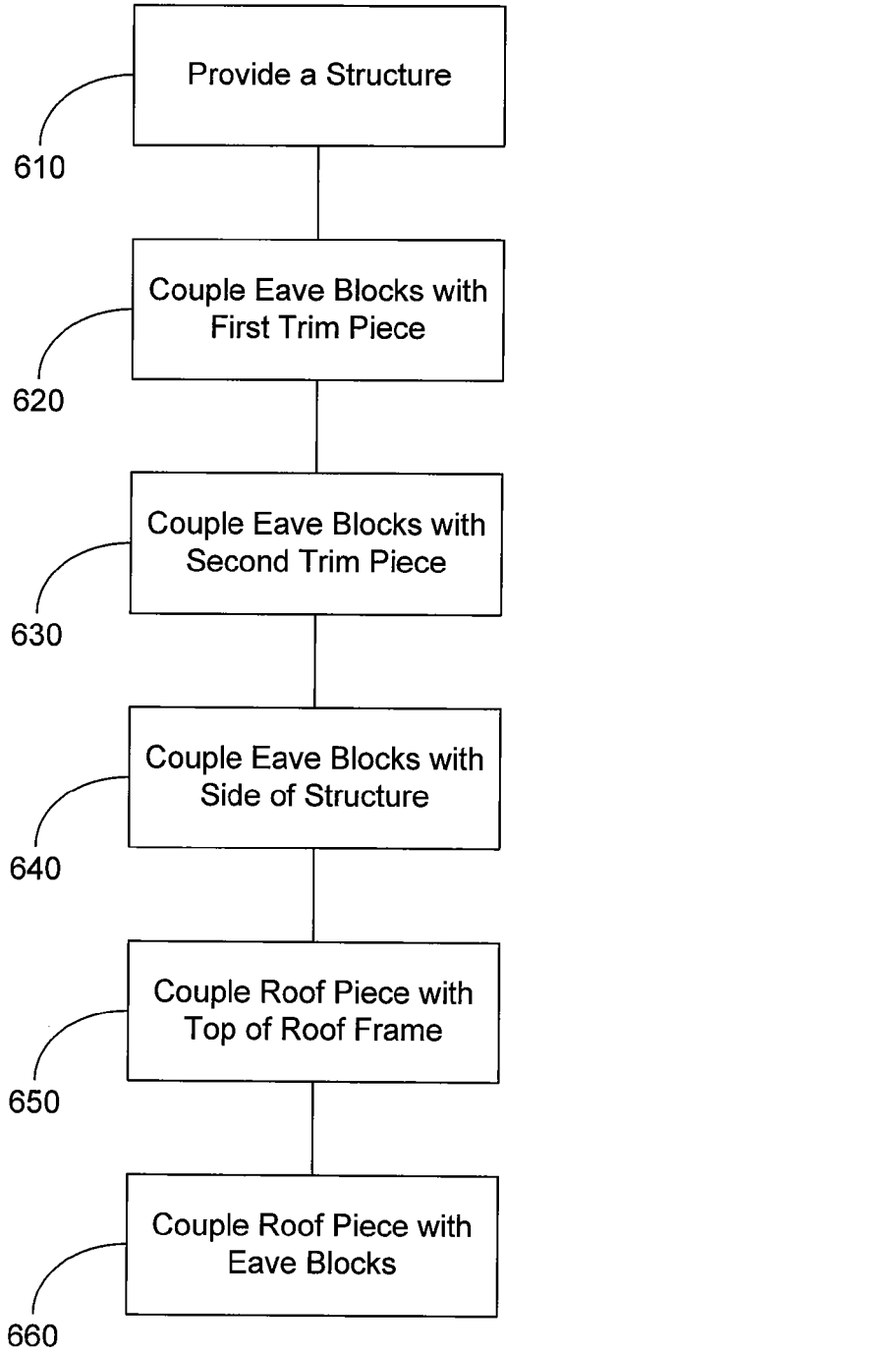
FIG. 6 is a block diagram of a method of the invention for making an eave for a building.

FIG. 6 shows a block diagram of one method 600 of the invention for making an eave for a building. At block 610 a structure may be provided. Eave blocks 260 may then be coupled with the first trim piece 270 at block 620. At block 630, eave blocks 260 may be coupled with the second trim piece 320. At block 640, eave blocks 260 may be coupled with the side of the structure. The roof piece 250 may then be coupled with the top of the roof frame at block 650. At block 660, roof piece 250 may be coupled with eave blocks 260. In various embodiments, the various steps may be performed in different order. For instance, roof piece 250 may be coupled with eave blocks 260 prior to coupling roof piece 250 with the top of the roof frame. In another example, first trim piece 270, or second trim piece 320 may be coupled with eave blocks 260 after eave blocks 260 have been coupled with the side of the building but prior to being coupled with roof piece 250. In some kit embodiments, various pre-coupled configurations of the first trim piece 270, second trim piece 320, eave blocks 260 and/or roof piece 250 may be provided in the kit before it is assembled by the user. The user may assemble the structure and then couple the eave assembly with the side of the building by coupling eave blocks 260 within the pre-coupled eave to the side of the building.

Figure 7:
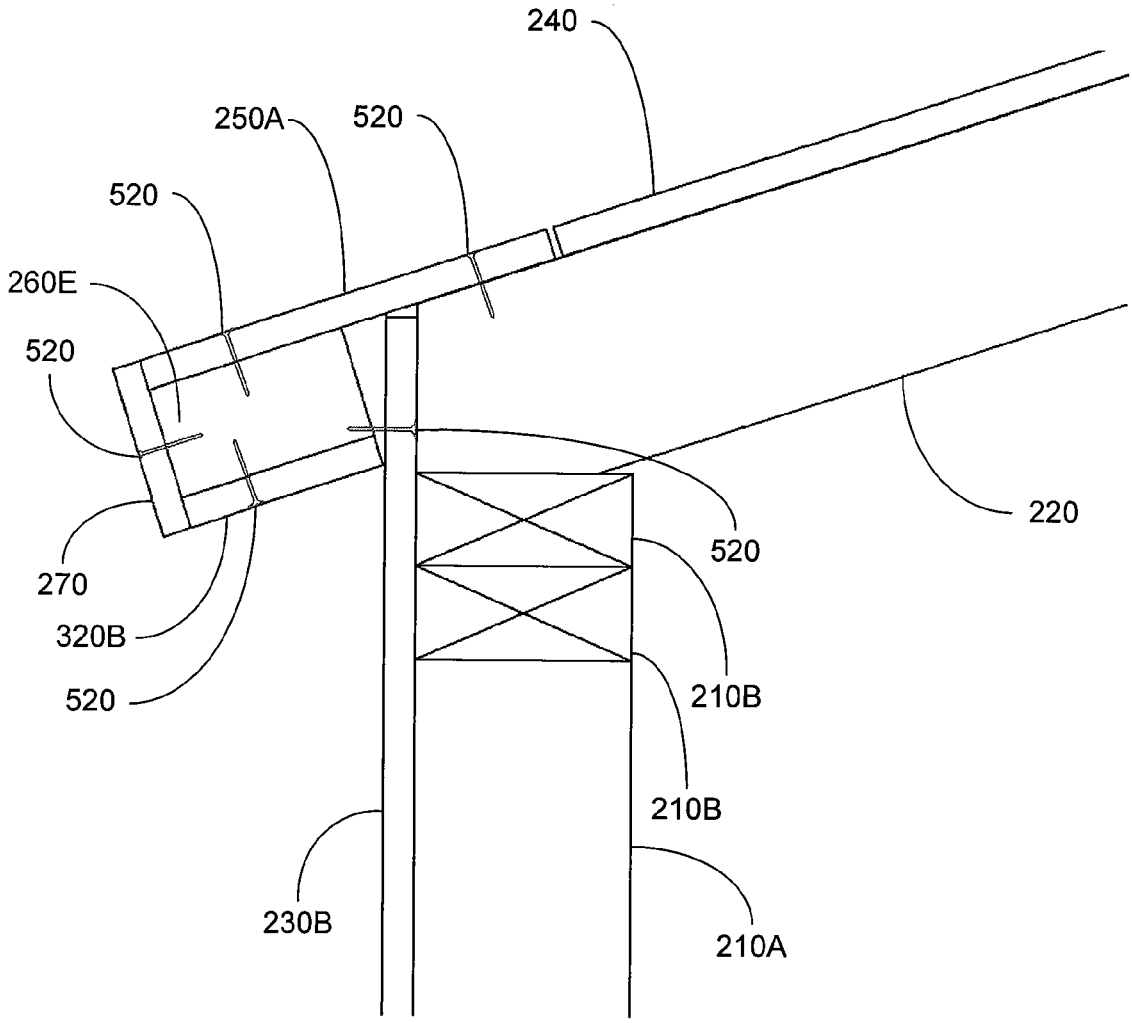
FIG. 7 is a cross-sectional view of an alternative eave of the invention.

FIG. 7 shows a cross-section view 700 of an alternative eave of the invention. Note that the roof block 260E is of a different configuration than those shown in FIG. 3, FIG. 4, and FIG. 5. In this embodiment, eave block 260E differs from previous eave blocks shown in FIG. 3, FIG. 4, and FIG. 5 in that it has a substantially rectangular cross-section. In some embodiments, eave block 260E may instead have a substantially square cross-section. In these or other embodiments, a top face of eave block 260E may be substantially parallel to the top of rafter element 220. In some embodiments, eave block 260E may be a piece of 2-by-4 softwood or other type of lumber with its grain running in a direction substantially parallel to the length of the eave block as well as the length of the eave and trim pieces. Also note that the coupling mechanism, nails 520 in this example, may be dimensionally smaller than in other embodiments where eave block 260 is configured differently.

Eave blocks of this configuration may be advantageous because they may constitute remainder and/or scrap materials from other portions of the structure's construction. Additionally, the length of the remainder materials or scrap may not need to be consistent, as different length eave blocks may be used along the length of the eave. Furthermore, eave blocks of this configuration may not require the same dimensional precision as eave blocks in other configurations. In these embodiments, the right side of eave block 260E may not be shaped to match, nor necessarily come into contact with, side 230B of structure. Therefore, eave block 260E may be almost any length and would not abut side 230B of structure, nor result in a gap between second trim piece 320B and side 230B of structure. A gap between second trim piece 320B and side 230B of structure may result in other embodiments when the eave block is mis-sized or mis-shaped.

In this embodiment, eave block 260E may be dimensioned as follows: the bottom and top may be in the range of about 2.5 inches (6.4 centimeters) to about 7.5 inches (19.1 centimeters) in length, and in some cases may be about 3.5 inches (8.9 centimeters) in length; the left and right sides may be in the range of about 0.5 inches (1.3 centimeters) to about 2.0 inches (5.1 centimeters) in length, and in some cases may be about 1.5 inches (3.8 centimeters) in length The length of eave block 260A may be in the range of about 3.5 inches (8.9 centimeters) to about 24 inches (61.0 centimeters), but can be any length depending on what is available during the construction of the eave The planes of the cuts on the ends of the eave blocks in these embodiments may or may not be square (perpendicular to the length of the eave block). In some embodiments, at least some of the dimensions of the eave blocks may depend on the dimensions of the trim pieces, or vice versa. In some embodiments, at least some of the dimensions of the eave blocks may be substantially the same as dimensions of the trim pieces.

Figure 8:
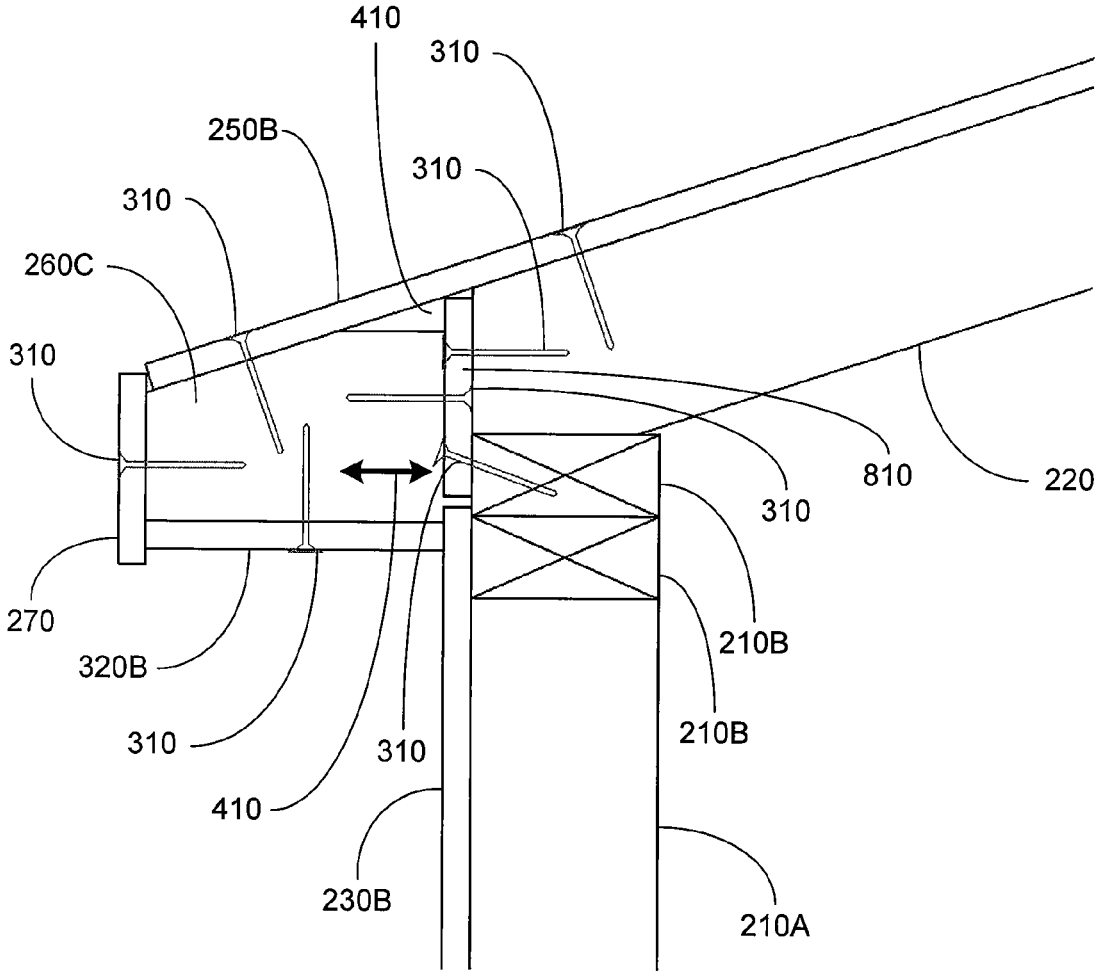
FIG. 8 is a cross-sectional view of another alternative eave of the invention.

FIG. 8 shows a cross-section view 800 of an alternative eave of the invention. In this embodiment, siding member 230B does not extend vertically to meet roof sheeting 250B. Instead, a height extension piece 810 is coupled with the right side of at least one of eave blocks 260C. Height extension piece may be made from any material, possibly one described above. In some embodiments, a pre-coupled eave unit which includes the eave blocks 260C, first trim piece 270, second trim piece 320B, and height extension piece 810 may be set on the top edge of siding member 230B such that the bottom of height extension piece 810 rests on the top of siding member 230B. A fastener, such as those described above, may then be used to couple the pre-coupled unit to the structure, possibly by coupling the height extension piece 810 to one or more of structural members 210B and/or rafter elements 220.

The addition of a height extension piece 810 may allow the height of the structure to be extended when standard size siding members 230B and structural members 210A are only available in less than a desired height. Furthermore, in the pre-coupled configuration described above, resting the pre-coupled eave unit on the top edge of siding member 230B may facilitate construction compared to embodiments where pre-coupled units must be held in position on the sheer vertical face of siding member 230B during coupling operations. Height extension pieces 810 may also be employed in other embodiments having different characteristics than those shown in FIG. 8. Merely by way of example, a height extension piece 810 may also be employed in an embodiment such as is shown in FIG. 3 and FIG. 5.

A number of variations and modifications of the invention can also be used within the scope of the invention. For example, in some embodiments, some rafter elements 220 may extend through the side of the structure and support at least a portion of the eave, while eave blocks 260 support other portions of the eave. In other possible embodiments, multiple roof pieces 250 may be used to complete the entire roof, including different sections along the length of the eave as it runs along the building edge.

The invention has now been described in detail for the purposes of clarity and understanding. However, it will be appreciated that certain changes and modifications may be practiced within the scope of the appended claims.

What is claimed is:

1. A building with an cave, comprising:

a structure with at least two sides and a roof frame;

a first trim piece;

a substantially rigid flat roof piece, wherein the substantially rigid roof piece is coupled with a top of the roof frame; and a plurality of eave blocks, wherein at least two of the plurality of eave blocks are coupled with the first trim piece and wherein at least two of the plurality of eave blocks are coupled with the substantially rigid roof piece to form an eave assembly that includes the at least two eave blocks, the first trim piece, and the substantially rigid roof piece; and wherein the eave assembly is coupled to the roof frame at least in part by coupling the substantially rigid roof piece to the roof frame such that the at least two eave blocks are at least partially supported by the substantially rigid roof piece.

2. The building with an eave of claim 1, further comprising:

a second trim piece, wherein the first trim piece is coupled with a side of the eave blocks, and the second trim piece is coupled with a bottom of the eave blocks.

3. The building with an eave of claim 1, wherein at least two of the plurality of eave blocks are coupled with a substantially rigid siding member on a side of the structure.

4. The building with an cave of claim 1, wherein:

the cave blocks are coupled with the first trim piece at intervals along a length of the first trim piece; and the eave blocks each comprise a piece of lumber having a grain direction, and the eave blocks are coupled with the first trim piece such that the grain direction is substantially parallel to the length of the first trim piece.

5. The building with an cave of claim 1, wherein each cave block is substantially rectangular and is coupled to the substantially rigid roof piece such that no face of the cave block is parallel to the side of the structure over which the cave hangs.

6. The building with an cave of claim 5, wherein the plurality of cave blocks comprises cave blocks of differing lengths.

7. A kit for making a building with an eave comprising:

a plurality of frame and substantially rigid siding members configured to be assembled to frame and side a structure with at least two sides and a roof frame;

a plurality of eave blocks;

a first trim piece; and a substantially rigid flat roof piece, wherein:

at least two of the plurality of eave blocks, the first trim piece, and the substantially flat roof piece are configured to be coupled together to form an eave assembly with the substantially rigid roof piece coupled with a top of at least two cave blocks; and the substantially rigid roof piece is configured to be coupled with a top of the roof frame such that after coupling, the at least two eave blocks are at least partially supported by the substantially rigid roof piece.

8. The kit for making a building with an eave of claim 7, wherein a side of the cave blocks is configured to be coupled with the first trim piece.

9. The kit for making a building with an cave of claim 7, further comprising a second trim piece, wherein a bottom of the cave blocks is configured to be coupled with the second trim piece.

10. The kit for making a building with an eave of claim 7, wherein the eave blocks each comprise a piece of lumber having a grain direction, and the kit further comprises instruction instructing a user to couple the eave blocks with the first trim piece such that the grain direction is substantially parallel to a length of the first trim piece.

11. The kit for making a building of claim 7, wherein the at least two eave blocks are configured to be coupled to one of the substantially rigid siding members.

12. The kit for making a building of claim 7, wherein each eave block is substantially rectangular and configured to couple with the substantially rigid roof piece without a side of the cave block being parallel to the side of the structure over which the cave is configured to hang.

13. The kit for making a building of claim 12, wherein the plurality of cave blocks comprises cave blocks of differing lengths.

14. A method of making an eave for a roof on a building comprising:

providing a structure with at least two sides and a roof frame;

coupling at least two of a plurality of eave blocks with a first trim piece;

coupling at least two of the plurality of eave blocks with a second trim piece; and coupling a substantially rigid flat roof piece with a top of at least two of the plurality of eave blocks;

wherein the plurality of eave blocks, the first and second trim pieces, and the substantially rigid flat roof piece form an eave assembly coupled to the structure at least in part by coupling the flat roof piece to a top of the roof frame, such that the at least two eave blocks are at least partially supported by the substantially rigid roof piece.

15. The method of making an eave for a roof on a building of claim 14, wherein coupling at least two of the plurality of eave blocks with the first trim piece comprises:

coupling a side of the eave blocks with the first trim piece.

16. The method of making an eave for a roof on a building of claim 14, coupling at least two of the plurality of eave blocks with the second trim piece comprises:

coupling a bottom of the eave blocks with the second trim piece.

17. The method of making an eave for a roof on a building of claim 14, wherein the eave blocks are coupled with the first trim piece prior to coupling the roof piece with the top of at least two of the plurality of eave blocks.

18. The method of making an eave for a roof on a building of claim 1, wherein the roof piece is coupled with the top of the structure and the top of the eave blocks such that the roof piece extends onto at least a portion of the top of the roof frame.

19. The method of making an eave for a roof on a building of claim 14, wherein the roof piece is coupled with the top of the structure and the top of the eave blocks such that the roof piece:

extends onto at least a portion of the top of roof frame; and extends substantially to the highest vertical point on the top of the roof frame.

20. The method of making an eave for a roof on a building of claim 1, wherein coupling at least two of a plurality of eave blocks with the first trim piece comprises coupling the cave blocks at intervals along a length of the first trim piece.

21. The method of making an cave for a roof on a building of claim 1, wherein the method further comprises coupling at least two of the plurality of cave blocks with a substantially rigid siding member on a side of the structure.

22. The method of making an cave for a roof on a building of claim 21, wherein coupling at least two of the plurality of cave blocks with a side of the structure comprises coupling all of the cave blocks with a side of the structure.

23. The method of making an eave for a roof on a building of claim 14, wherein the eave blocks each comprise a piece of lumber having a grain direction, and the eave blocks are coupled with the first trim piece such that the grain direction is substantially parallel to a length of the first trim piece.

* * * * *

UNITED STATES PATENT AND TRADEMARK OFFICE

CERTIFICATE OF CORRECTION

PATENT NO. : 7,845,118 B2
APPLICATION NO. : 11/684940
DATED : December 7, 2010
INVENTOR(S) : Tom Saurey It is certified that error appears in the above-identified patent and that said Letters Patent is hereby corrected as shown below:

In the Claims of the Invention

Col. 12, Line 10, please delete "cave" and insert --eave--

Col. 12, Line 34, please delete "cave" and insert --eave--

Col. 12, Line 35, please delete "cave" and insert --eave--

Col. 12, Line 41, please delete "cave" and insert --eave--

Col. 12, Line 41, please delete "cave" and insert --eave--

Col. 12, Line 43, please delete "cave" and insert --eave--

Col. 12, Line 44, please delete "cave" and insert --eave--

Col. 12, Line 46, please delete "cave" and insert --eave--

Col. 12, Line 47, please delete "cave" and insert --eave--

Col. 12, Line 47, please delete "cave" and insert --eave--

Col. 12, Line 60, please delete "cave" and insert --eave--

Col. 13, Line 2, please delete "cave" and insert --eave--

Col. 13, Line 4, please delete "cave" and insert --eave--

Col. 13, Line 6, please delete "cave" and insert --eave--

Signed and Sealed this
First Day of March, 2011

David J. Kappos

David J. Kappos
*Director of the United States Patent and Trademark Office*

Col. 13, Line 20, please delete “cave” and insert --eave--

Col. 13, Line 21, please delete “cave” and insert --eave--

Col. 13, Line 23, please delete “cave” and insert --eave--

Col. 13, Line 23, please delete “cave” and insert --eave--

Col. 14, Line 15, please delete “claim 1” and insert --claim 14--

Col. 14, Line 27, please delete “claim 1” and insert --claim 14--

Col. 14, Line 28, please delete “cave” and insert --eave--

Col. 14, Line 30, please delete “cave” and insert --eave--

Col. 14, Line 31, please delete “claim 1” and insert --claim 14--

Col. 14, Line 32, please delete “cave” and insert --eave--

Col. 14, Line 34, please delete “cave” and insert --eave--

Col. 14, Line 36, please delete “cave” and insert --eave--

Col. 14, Line 37, please delete “cave” and insert --eave--